US006010402A

United States Patent [19]

Schmidt

[11] Patent Number: 6,010,402

[45] Date of Patent: Jan. 4, 2000

[54] AIR DIFFUSERS AND DEFLECTOR STRUCTURE THEREFOR

[75] Inventor: Donald J. Schmidt, Winnipeg, Canada

[73] Assignee: E.H. Price Limited, Winnipeg, Canada

[21] Appl. No.: 08/929,768

[22] Filed: Sep. 15, 1997

[51] Int. Cl.[7] ..... F24F 13/06; F24F 7/00

[52] U.S. Cl. ..... 454/300; 454/299

[58] Field of Search ..... 454/299, 300

[56] References Cited

U.S. PATENT DOCUMENTS

| | | | |
|---|---|---|---|
| 2,636,668 | 4/1953 | Meyer et al. | 230/274 |
| 2,977,869 | 4/1961 | O'Day . | |
| 2,983,214 | 5/1961 | O'Day | 454/299 |
| 3,046,866 | 7/1962 | Straub et al. . | |
| 3,110,242 | 11/1963 | O'Day . | |
| 3,205,809 | 9/1965 | Sweeney et al. . | |
| 3,221,633 | 12/1965 | Sweeney . | |
| 3,238,860 | 3/1966 | O'Day et al. . | |
| 3,254,587 | 6/1966 | Sweeney . | |
| 4,763,565 | 8/1988 | Brown . | |
| 5,292,282 | 3/1994 | Callas | 454/292 |
| 5,338,256 | 8/1994 | Tonna | 454/310 |

FOREIGN PATENT DOCUMENTS

| | | |
|---|---|---|
| 1594964 | 8/1981 | United Kingdom . |
| 2221530 | 2/1990 | United Kingdom . |

OTHER PUBLICATIONS

Anemostat Products Division "Catalog DD–1 Directional Air Diffusers" Mar. 1994, cover page, p. 14 and back page.

*Primary Examiner*—William Doerrler
*Attorney, Agent, or Firm*—Ridout & Maybee

[57] ABSTRACT

An air diffuser with a series of parallel blades has an air deflector structure for reducing throw and promoting better air mixing near the diffuser, having support members diverging transversely from one another laterally outwardly. Each support member has a series of vanes that diverge transversely laterally outwardly and extend through inner and outer regions adjacent or between the blades. A vane may have a forwardly extending barb having a sharp apex projecting into a recess forwardly of an outer rear edge of a forwardly adjacent vane, for biting engagement with a blade, and the same or another vane may have an undercut portion projecting outwardly rearwardly beyond an inner edge portion of a rearwardly adjacent vane, for engaging under a blade for firmly locating the deflector structure relative to the blades.

14 Claims, 4 Drawing Sheets

AIR DIFFUSERS AND DEFLECTOR STRUCTURE THEREFOR

BACKGROUND OF THE INVENTION

The present invention relates to air diffusers and deflector structures therefor.

A known form of air diffuser comprises a series of blades that are each generally inclined laterally at an angle to an axis of the diffuser. Such air diffusers are commonly found in a ceiling where air is to be introduced in a one, two, three or four way air stream along the ceiling. The air stream velocity is gradually reduced as it moves along the ceiling and is entrained or mixed with the room air. Sometimes, insert devices are used in such air diffusers to spread the air stream and reduce its throw. ASHRAE defines "throw" as the horizontal or vertical axial distance an air stream travels after leaving an outlet before maximum stream velocity is reduced to a specified terminal velocity (e.g. 50, 100, 150 or 200 feet per minute). The nature or shape of the air distribution pattern can often usefully be judged by considering an isovel pattern. An isovel pattern links points in the air flow having equal velocity e.g. 50 fpm.

With the use of such insert devices, a four way essentially cruciform isovel pattern tends, for example, somewhat toward a radial or circular pattern, while a three way pattern approaches somewhat a semi-circular isovel pattern. As a result, more air can be introduced into the room with less drafts, since throw (and thus air velocity near the diffuser) is reduced. Shorter throws indicate more entrainment and better mixing with room air near the diffuser.

Known insert devices of which applicant is aware are not as efficient as may be considered desirable in reducing throw and promoting a more nearly uniform radial isovel pattern.

BRIEF SUMMARY OF THE INVENTION

In a first aspect of the present invention there is provided an air diffuser comprising a series of parallel blades each generally inclining laterally with respect to an axis of said diffuser, and air deflector structure comprising first and second support members each diverging transversely from the other laterally outwardly from an inner region adjacent an inner side of a blade, and across at least one blade on a first side of said at least one blade to an outer region outwardly of said series, each support member having a series of vane elements connected thereto comprising at least an inner vane element and an outer vane element, and said vane elements disposed in planes that diverge transversely laterally outwardly and extending from the support member and laterally outwardly from said first side through at least the inner and said outer region, respectively, toward an opposite side of each blade.

With this arrangement, spreading out or divergence of the air stream is achieved by the divergency of the vane elements attached to the first and second support members, respectively and hence these vane elements can be disposed at a relatively small angle with respect to the axis of the diffuser. Hence, there is relatively little obturation or obstruction of the air flow, and throw is reduced efficiently.

The invention also provides improved arrangements for securement of the deflector structure to the blades of the air diffuser. In a second aspect, the invention provides a deflector structure comprising a support member and a series of vane elements connected thereto and extending therefrom and comprising at least an inner vane element and an outer vane element, at least one vane element having an outer rear edge having an inwardly extending recess therein and a vane element rearwardly adjacent therefrom having on an inner front edge a forwardly extending barb having a sharp apex projecting into said recess forwardly of said outer rear edge.

In a third aspect, the invention provides a deflector structure comprising a support member and a series of vane elements connected thereto and extending therefrom and comprising at least an inner vane element and an outer vane element, and wherein at least one vane element has a forwardly leading inner edge portion, and a vane element forwardly adjacent thereto has an outer rear edge having an undercut portion projecting outwardly rearwardly beyond said inner edge portion.

These arrangements according to the second and third aspects of the invention provide for increased convenience of application and security of attachment to the diffuser blades.

Preferred embodiments of the present invention will be described in more detail with reference to the accompanying drawings.

DETAILED DESCRIPTION OF THE INVENTION

Figure 1:
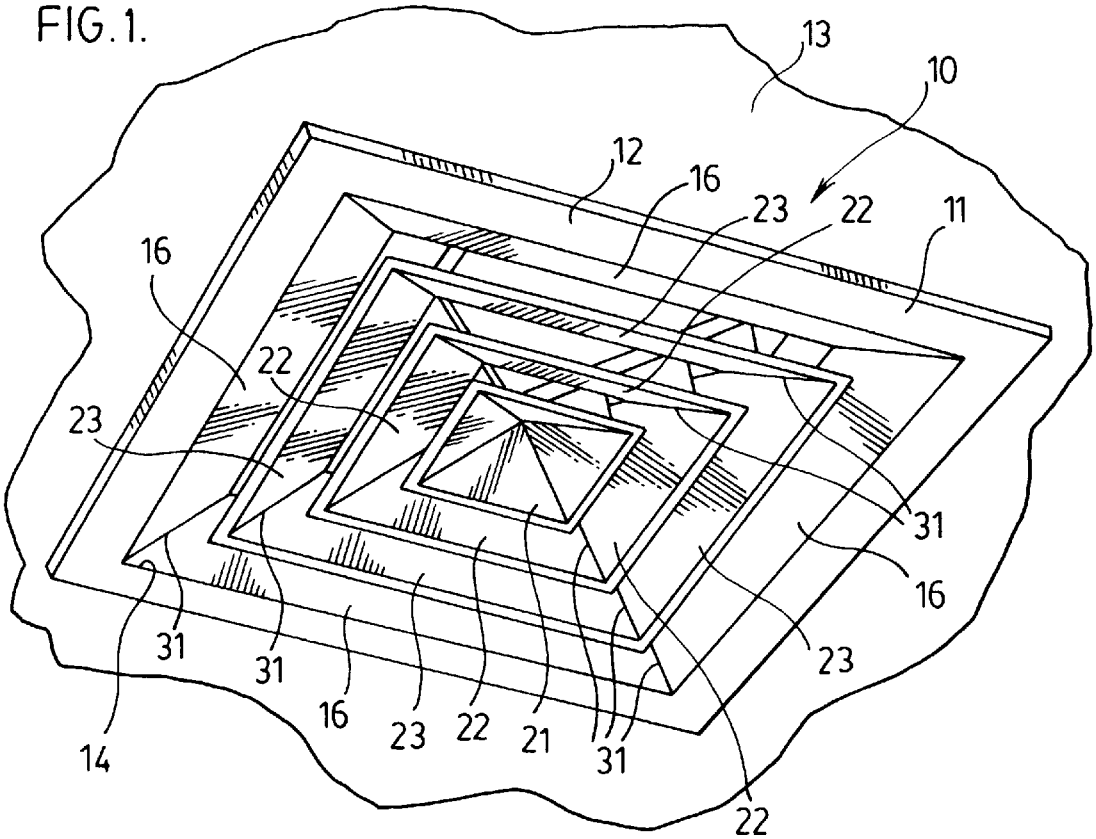
FIG. 1 is a perspective view from underneath of an air diffuser in accordance with the invention installed in a ceiling.
Figure 2:
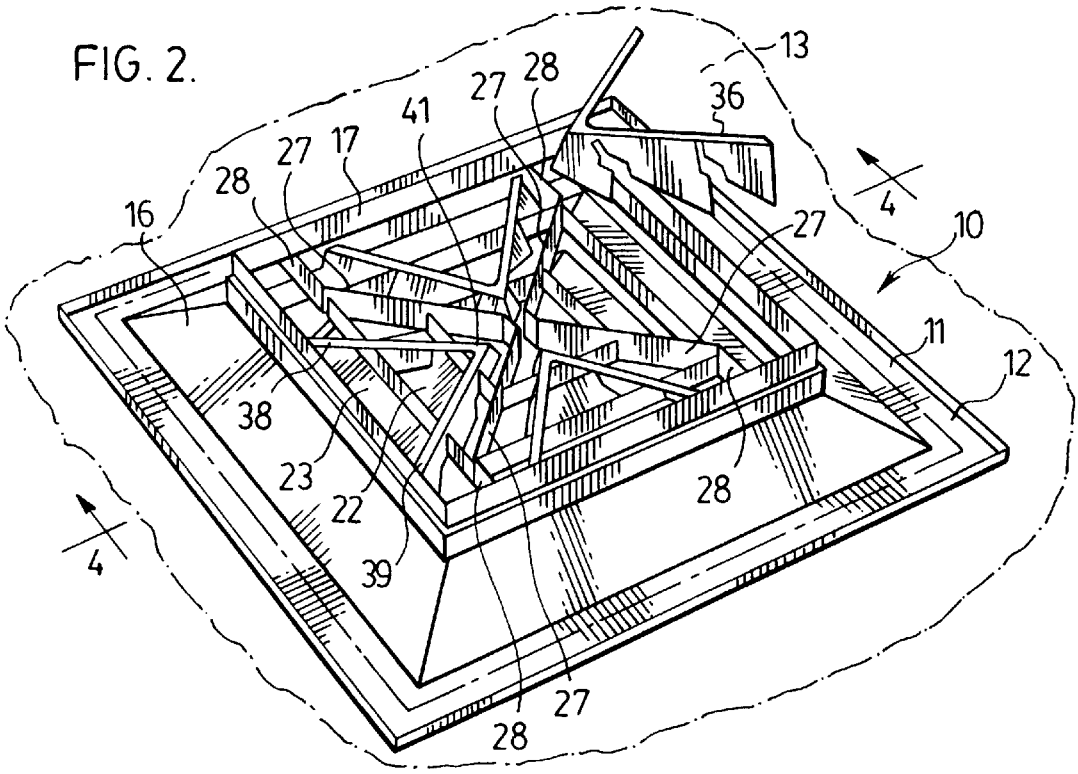
FIG. 2 is a perspective view from above of the diffuser of FIG. 1.
Figure 4:
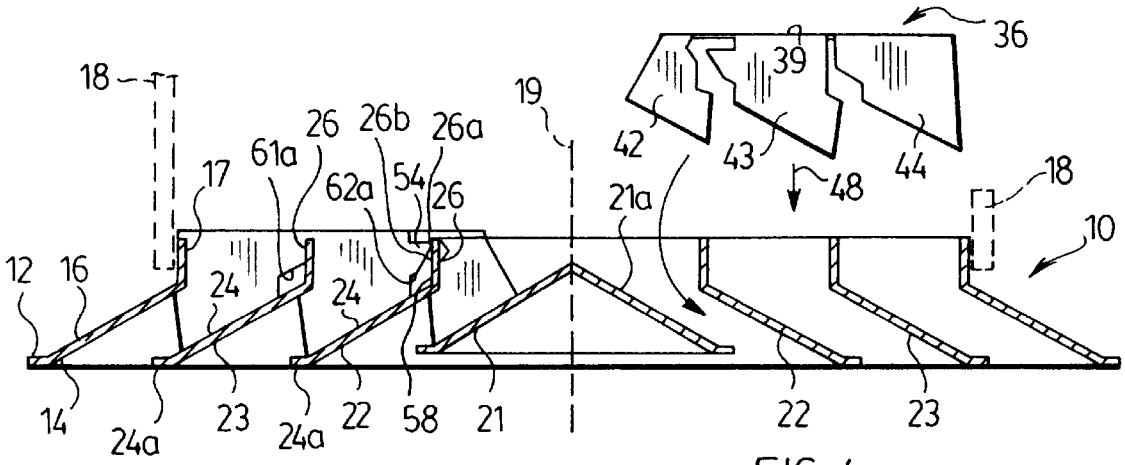
FIG. 4 is a lateral side view, partially in section, showing installation of an air deflector structure in the diffuser of the invention.

Referring to the accompanying drawings, FIGS. 1, 2 and 4 illustrate a four way air diffuser having a conventional arrangement of diffuser blades.

The diffuser 10 comprises a rectangular, in this example square, frame 11 comprising a planar edge flange 12 adapted to be applied to the underside of a ceiling structure 13 around the perimeter of an aperture in the ceiling structure 13. An inner edge 14 of the flange 12 defines a rectangular or square outlet for delivery of air into the space beneath the ceiling 13. The outer perimeter of the air outlet passage is defined by a skirt comprising upwardly and inwardly inclining side walls 16 that unite at their upper ends with generally vertical side walls 17 defining a rectangular or square duct. Air, for example conditioned air or the like may be introduced from an input duct 18 shown in broken lines in FIG. 4 sealingly connected to the upper end of the wall 17. Typically, such duct 18 will be connected through duct work to an air source for passing heated or conditioned air through the diffuser 10.

In this example, the air diffuser blade or louver arrangement comprises four symmetrical sets of blades each generally triangular in plan and meeting at a central vertical axis 19 which is parallel with the initial direction of air inflow to the diffuser structure 10 through the duct 18.

At the center of the diffuser is disposed a pyramidal shell 21 having its edges parallel with the opening 14.

Laterally outwardly from each side of the shell is disposed a series of laterally uniformly spaced blades. In this example, the series comprises two blades 22 and 23. In this example, each blade 22 or 23 consists of a main or lower blade portion 24 each inclining parallel to the others laterally outwardly downwardly away from the axis 19 and terminating in a lip or end flange 24*a* coplanar with the edge flange 12. Each blade portion 24 connects at its upper edge with an upper blade portion 26 extending parallel to the axis 19 and to the adjacent side walls 17. The blades 22 and 23 are held in spaced relationship and are supported by generally diagonally extending support members 27 that are connected to the upper portions 26 and to the upper side of the shell 21. The support members 27 connect with transversely extending connection members 28 that connect, preferably detachably, at their outer ends with the side walls 17, so that the entire subassembly of shell 21, blades 22 and 23, and support and connecting members 27 and 28 can, if desired, be removed from the frame 11 by manipulation from the space below the ceiling 13, for the purposes of cleaning, adjustment or replacement of the louver blade structure.

As best seen in FIG. 1, at each end the blades 22 and 23 of each set unite with the ends of blades 22 and 23 of adjacent sets along generally diagonally extending connecting lines 31. The pyramidal shell 21, usually termed a cone, comprises triangular blade-like portions 21*a* each inclining parallel to the blades 22 and 23 adjacent to it. Each portion 21*a* can be considered to form part of the set of blades including blades 22 and 23 that incline parallel to it.

As noted above, in the absence of air deflector structure applied in the air diffuser, normally the throw or isovel pattern from the above described four way diffuser is essentially cruciform in plan exhibiting lobes that extend transversely along the underside of the ceiling structure 13 markedly outwardly and along the center line of each triangular set of diffuser elements constituting the four way diffuser.

The present invention provides novel air deflector structure 36, one preferred example of which is best seen in FIGS. 2 to 6, and that is inserted into the air diffuser 10, and efficiently reduces the throw of the diffuser creating an isovel pattern or plot that tends toward or approaches a uniformly radial or circular pattern centered on the axis 19.

As with the arrangement of the sets of blades 22 and 23 constituting the air diffuser 10, each deflector structure 36 is preferably symmetrical about a laterally extending median plane extending vertically through an axis 37 and comprises first and second support members 38 and 39 that diverge transversely from one another, transversely from the axis 37 and that preferably are integrally connected at an apex 41. Connected on each support member 38 and 39 is a series of generally triangular plate form vane elements each inclining from a transversely outer edge of the support member and comprising an inner vane element 42, at least one intermediate vane element 43 and an outer vane element 44. In use, these vane elements 42 to 44 are disposed in the regions between and adjacent the blades 22 and 23 and, as will be appreciated, the number of vane elements may be modified as desired in order to match the number of blades 22, 23 and the like present in the diffuser structure to which the deflector is to be applied.

Figure 3:
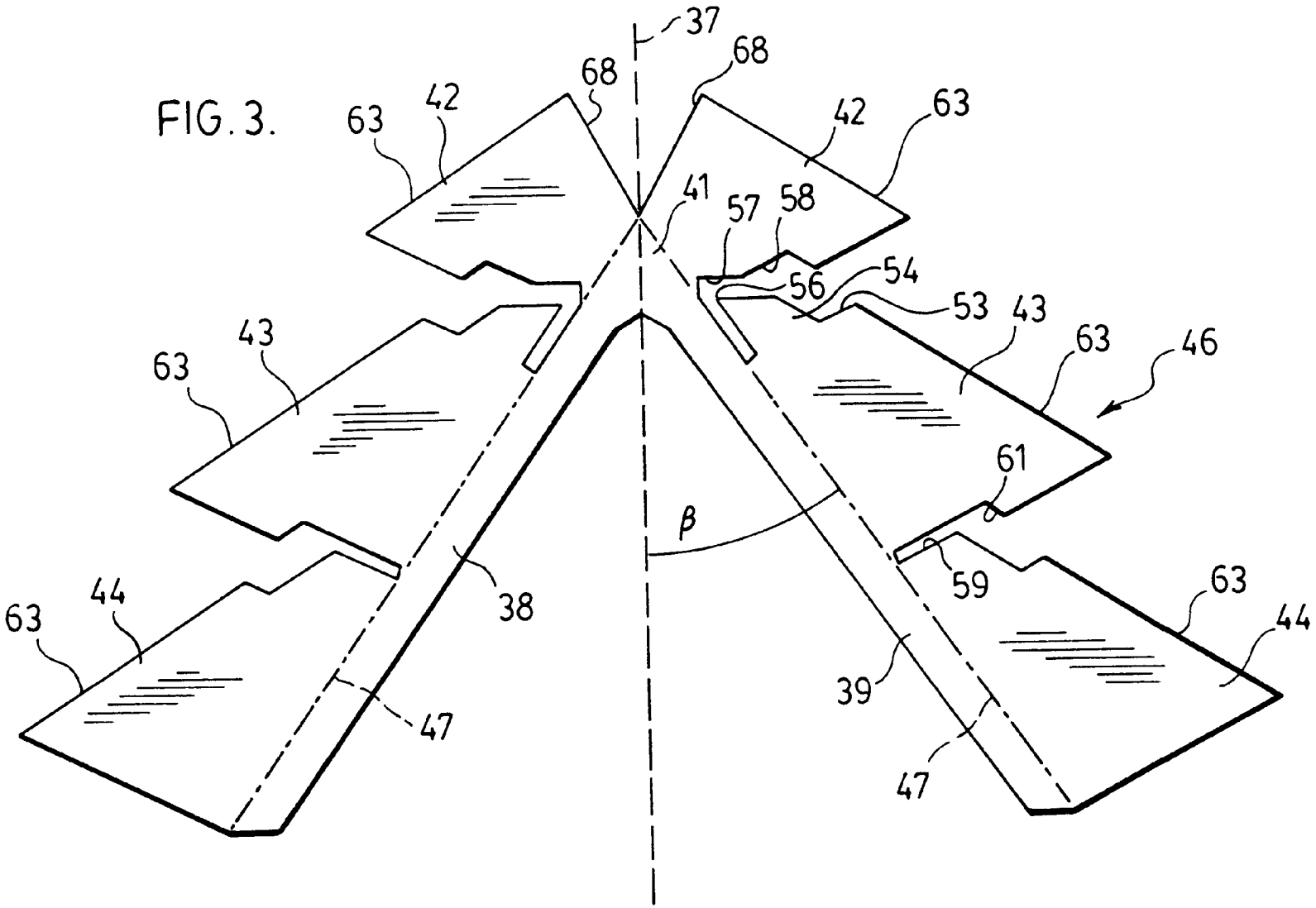
FIG. 3 is a plan view of a sheet metal blank bendable to form an air deflector structure in accordance with the invention.
Figure 6:
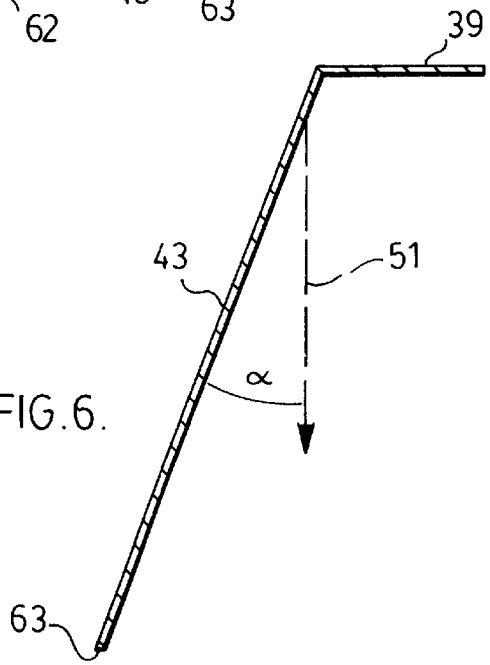
FIG. 6 is a transverse cross section taken on the line 6—6 in FIG. 5 through the air deflector.

Conveniently, the deflector structure 36 is formed from a blank 46 as seen in FIG. 3 cut or stamped from sheet metal, for example sheet steel or aluminum, the vane elements 42 to 44 being bent downwardly about a preferably linear bending axis 47 as seen in FIGS. 3 and 6 so that they are inclined with respect to the plane of the support member 38 or 39.

In use, an air deflector structure 36 is applied preferably to each of the sets of blades 22 and 23, by pressing it downwardly from an upper side in the direction of the arrow 48 in FIG. 4. In the installed position, for example as illustrated in FIGS. 2 and 4, the support members 38 and 39 lodge on and extend outwardly across a first side, namely the upper side, of the adjacent first side edges, namely the upper edges, of the blades 22 and 23. The support members 38 and 39 diverge transversely laterally outwardly from one another from an inner region adjacent the inner side of the first blade 22 and across an intermediate region defined between the first blade 22 and the second blade 23 to an outer region disposed outwardly between the outer blade 23 and the skirt 16. Similarly, in the installed position, the vanes 42 to 44 extend laterally outwardly away from the support members 38 and 39 toward an opposite or lower side edge of blades 22 and 23 and lodge, as best seen in FIG. 4, respectively in the inner region adjacent the inner side of the first blade 22 and outwardly from the shell 21, in the space between the blades 22 and 23, and in the space outwardly from the blade 23, respectively.

Figure 5:
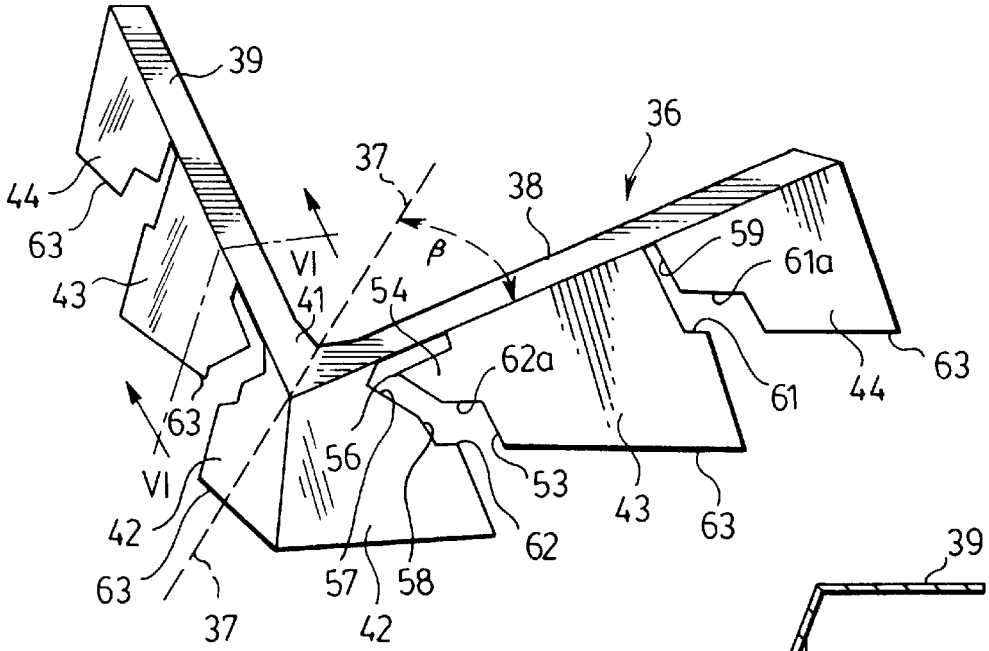
FIG. 5 is an isometric view of an air deflector structure of the invention.

As best seen in FIGS. 2 and 5, the vanes 42 to 44 are disposed in planes that diverge transversely laterally outwardly, along with the support members 38 and 39, with respect to the axis 37, and hence they define a pair of transversely outwardly diverging air deflection passages on the outer side of the arms 38 and 39, respectively. In use, these flow passages serve to spread the air stream and reduce its throw in an effective and efficient manner. Since the vanes 42 to 44 connected on one support member, e.g. member 38, are disposed in planes that diverge transversely outwardly with respect to the plane of the corresponding element 42 to 44 connected on the other of the support member 39, the vanes do not rely for their effectiveness in transversely spreading the air flow on transverse extension of the vane elements. Hence, the angle $\alpha$, as seen in FIG. 6, representing the angle between a vane element, such as element 43 and a plane 51, for example a vertical plane, parallel to the axis 19 in the installed position may be relatively acute. For example, the angle $\alpha$ may be in the range 0° to about 40°. More preferably, however, to facilitate insertion of the vanes 42 to 44 into the regions adjacent to and between the blades 22 and 23, the vanes splay somewhat outwardly from the support members 38 and 39. Hence, more preferably the angle $\alpha$ is about 5° to about 40°.

If the angle $\alpha$ is significantly above about 40°, the air flow may be excessively obturated, and problems of increased pressure drop and of noise generation may arise. More preferably, the angle $\alpha$ is about 10° to about 25°, more preferably about 15° to about 20°. In one preferred form, the angle is about 18°.

The angle of transverse divergence of the vane elements 42 to 44 e.g. in the example illustrated the angle at which they incline transversely outwardly at angle $\beta$ with respect to a lateral median plane passing through the axis 37 is preferably in the range about 10° to about 60°. If this angle of divergence is greater than about 60°, the air flow may be excessively restricted, while with angles less than about 10°, the extent of reduction of throw is generally less than is desirable. More preferably, this angle is in the range about 20° to about 50°, still more preferably about 30° to about 40°. In one particularly preferred form, the angle is about 35°.

As will be appreciated, in the example illustrated, the angle β is the angle at which each blade diverges from the axis 37 when viewed in transverse cross section taken on a plane perpendicular to axis 19, for example a horizontal plane when the diffuser 10 is disposed horizontally and the axis 19 vertically.

In the installed position, where as in the example of FIGS. 1, 2 and 4, each blade set 22 and 23 is symmetrical about a lateral median plane (for example the plane of the paper in FIG. 4), preferably each structure 36 is disposed symmetrically with respect to this plane.

In a particularly preferred form of the deflector structure, an inner or front edge and/or an outer or rear edge of at least one vane element is provided with formations for facilitating secure attachment of the air deflector structure to the blades.

As best seen in FIGS. 3 and 5, in the example illustrated, one element selected from the intermediate element 43 and outer element 44 is provided on an inner or front edge 53 with a forwardly extending barb 54 having a sharp apex 56 that, in the disassembled condition as seen in FIG. 5, projects forwardly into an inwardly extending recess 57 in an outwardly or rearwardly facing edge 58 of the vane element 42 forwardly adjacent to the intermediate element 43. In the installed position, as seen in FIG. 4, the rear edge 58 engages a forwardly extending surface 26*a* of the upper blade portion 26 while the apex of the barb 54 engages an opposite face 26*b*. The thickness of the upper blade portion 26 is accommodated by the support member 38 or 39 flexing resiliently, and the resilient reaction applies a compressive force to the barb 54 tending to urge its sharp apex 56 toward and into biting engagement with the rear side 26*b* of the blade portion 26. In this manner, because of this slight interference fit between the blade portion 26 and the barb 54, once inserted, the deflector structure 36 is held securely relative to the diffuser structure 10 and this assists in preventing the deflector insert 36 from being shifted transversely along a blade 22 or 23 as well as assisting in preventing the insert 36 from lifting out of the diffuser structure.

To further assist in locating the deflector structure and preventing it from lifting out of the air diffuser structure, in the preferred form, as best seen in FIGS. 3 to 5, at least one intermediate vane element 43 or an outer vane element 44 has a forwardly leading inner edge portion, such as portion 59 on vane element 44, or the apex 56 of the barb 54 on vane element 53 that engages a rear side face, for example side faced 26*b* of a blade element such as element 22, while the vane element forwardly adjacent thereto (vane element 43 in the case of vane element 44, or vane element 42 in the case of vane element 43) has an undercut portion 61 in the case of vane element 43 or 62 in the case of vane element 42 that projects outwardly rearwardly beyond the inner portion 59 and 56, respectively.

With this arrangement, as seen in FIG. 4, the blade elements 42 and 43 tend to deflect resiliently transversely outwardly as the deflector structure is inserted into the diffuser, this outward deflection being assisted somewhat by a camming action between the upper face of the blades 22 and the lower edges 63 of the transversely outwardly diverging vane elements 42 to 44, until the upwardly facing undercut portions 61 and 62 snap under the lower faces of the blades 22 and 23, as seen in FIG. 4. Hence, in the installed position, the deflector structure snap fastens to the blades 22 and 23 and this tends to resist upward displacement of the deflector structure 36 relative to the blades 22 and 23.

Preferably, an undersurface 61*a* or 62*a* on the vane rearwardly adjacent the vane having the undercut 61 or 62 is spaced therefrom at a distance greater than the thickness of the blade element 22 or 23 in order to provide a spacing, as best seen in FIG. 4 in order to accommodate structure that may optionally be present on the upper side of the blade 22 or 23, such as staking channels sometimes present on the upper sides of aluminum blade structures.

In the preferred form, for simplicity of manufacture of the structure 36, the vane elements 42 to 44 on each arm or support member 38 or 39 are coplanar with one another, as in the example seen in FIGS. 3 to 5. Such co-planarity is not essential, however. For example, the axes about which the vane elements 42, 43 or 44 are bent relative to the support arm 38 or 39 may be slightly skewed or offset from the axis 47, so that the elements 42, 43 and 44 are disposed at slight angles relative to one another.

Various modifications to the above structure may, of course, be made.

While the above has described the deflector comprising support members 38 and 39 that are joined integrally at the apex 41 it is possible, although with some considerable disadvantage to employ two separate support members, such as would be obtained by severing the item as seen in FIGS. 3 and 5 along the axis 37. This, however, increases the inventory of pieces involved and the complexity of the assembly procedure. With the preferred form, wherein the support members 38 and 39 are integrally joined, assembly is greatly facilitated and it is not necessary to position the portions 38 and 39 relative to one another. For example, in the preferred form, the leading edges 68 of the inner vane elements 42 may coincide, as seen in FIG. 5, in the as manufacture and installed position, and it would be somewhat difficult to dispose separate pieces in this manner. Further, in the preferred form, the integral pieces 38 and 39 provide a resilient backbone relative to which the vane elements 42, 43 and 44 tend to splay outwardly resiliently as they are pressed home between the blades 22 and 23, and this tends to increase the frictional contact between the deflector structure 36 and the diffuser structure 10, thus increasing the stability of the deflector structure relative to the diffuser 10 and reducing the tendency for vibration of the deflector 36 relative to the diffuser structure 10 and hence tending to reduce noise generation.

While in the example described in detail above, the blade 22 and 23 comprise angularly disposed generally planar portions 24 and 26, as will be understood, the vane elements 42 to 44 may be shaped to accommodate and to attach to other forms of blade contour, for example wholly planar blades, or blades that are arcuate in cross section. The modifications to the shapes of the blades and to the arrangements of the barbs 54 or undercuts 61 and 62 in order to conform to these other blade structures are readily apparent to one of ordinary skill in the art.

The deflector structure described in detail above can readily be modified to accommodate diffusers that are simpler or of greater size or complexity than that illustrated in FIGS. 1, 2 and 4 and having a lesser or greater number of blades. Further, the deflector structure is well adapted to be used with advantage in other forms of diffuser structure, such as three way, two way or one way directional diffusers.

For example a simple diffuser may have a shell or "cone" 21 and only one blade 22. In such case, the deflector may comprise on each support member 38 and 39 only an inner vane, e.g. like vane 42 and an outer vane like vane element 43.

Figure 7:
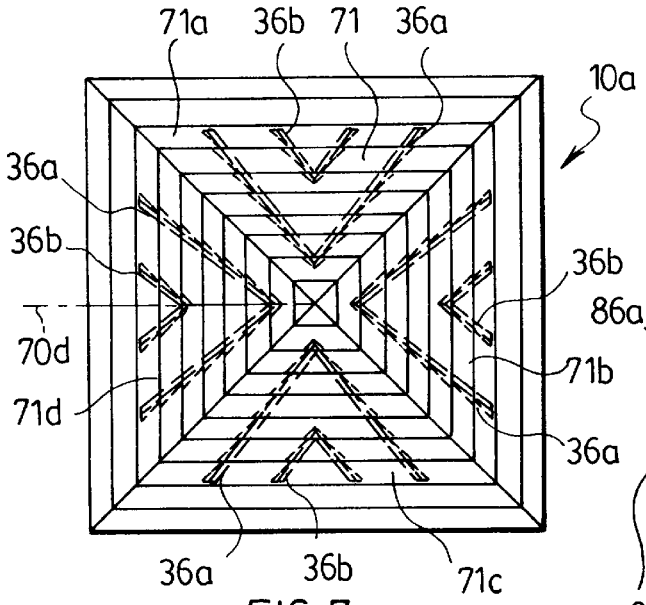
FIG. 7 is a top plan view of a four way air diffuser showing a modified arrangement of the air deflector structures.

FIG. 7 shows a top plan view of a diffuser structure 10*a* of increased size having a multiplicity of blades 71 disposed in a four way directional diffuser arrangement, and comprising blade sets 71*a* to 71*d*. Each of these blade sets has two deflector structures 36*a* and 36*b* attached to it similar to the structure 36 described above, and each arranged symmetrically with respect to the median lateral plane of each blade set, e.g. plane 70*d* in the case of blade set 71*d*. Deflectors 36*a* comprises a structure that is elongated as compared to the structure described above with reference to FIGS. 1 to 6 and comprises an increased number of the intermediate vane elements 43, so that a vane element is disposed in each of the inner intermediate and outer region adjacent the blades 71. The auxiliary deflector structure 36*b* positioned centrally with respect to the deflector 36*a* may comprise a three vane element similar to the deflector structure 36 described above in detail with reference to FIGS. 1 to 6.

Figure 8:
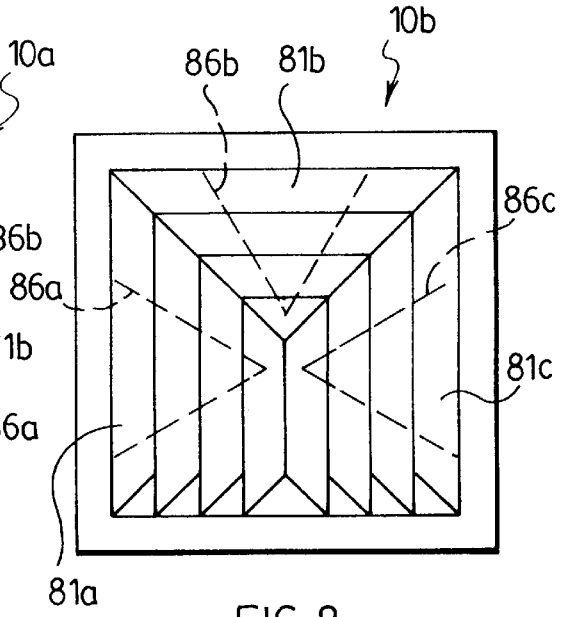
FIGS. 8, 9 and 10 are somewhat schematic bottom views of air diffuser structures in accordance with the invention illustrating preferred locations of the air deflector structures.

FIG. 8 is a bottom plan view illustrating somewhat schematically a three way diffuser structure 10*b* and comprising a first blade set 81a, a second blade set 81*b* inclining laterally with respect to the diffuser at an angle of 90° with respect to set 81*a* and a third set 81*c* inclining in a direction opposite to that of the set 81*a* and at 90° to the blade set 81*b*. Deflector structures 86*a*, 86*b* and 86*c* similar to structure 36 described above in detail are attached to the blade structures 81*a* to 81*c*, respectively. These deflector structures serve to reduce the throw of the air flows emanating in three way fashion from the blade sets 81*a* to 81*c*, respectively. The diverging deflector structures having sufficient vane elements to be interposed into the inner, intermediate and outer regions between the blades and their structure and application will be readily apparent to those of ordinary skill in the art having regard to the foregoing disclosure.

Figure 9:
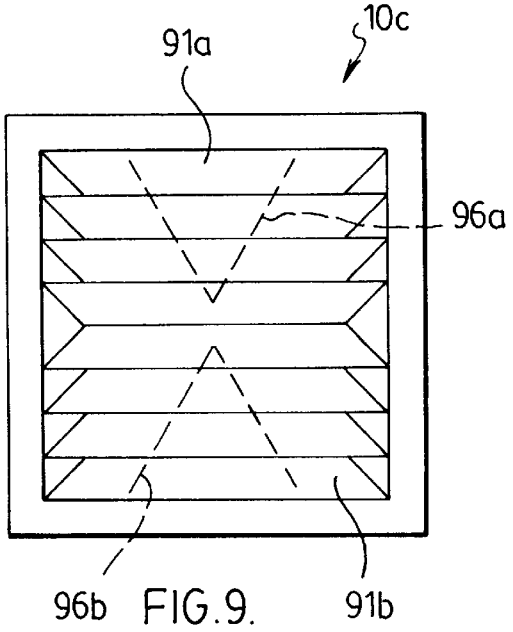

Likewise, FIG. 9 is a somewhat schematic view of a two way diffuser structure 10*c* having a first blade set 91*a*, and second blade set 91*b* inclining in a direction disposed at 180° with respect to the direction of inclination of the blade set 91*a*, and provided with deflector structures 96*a* and 96*b* similar to structure 36 and configured and applied in accordance with the principles described above.

Figure 10:
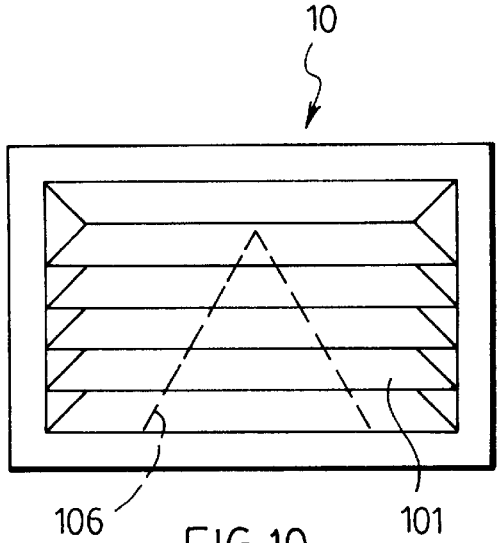

Similarly, FIG. 10 shows a one way directional diffuser 10*d* having blades 101 each inclining in the same lateral direction with respect to the axis of the diffuser and having a deflector structure 106 similar to the structure 36 described above.

I claim:

1. An air diffuser comprising a series of parallel blades each generally inclining laterally with respect to an axis of said diffuser, and air deflector structure comprising first and second support members each diverging transversely from the other laterally outwardly from an inner region adjacent an inner side of a blade, and across at least one blade on a first side of said at least one blade to an outer region outwardly of said series, each support member having a series of vane elements connected thereto comprising at least an inner vane element and an outer vane element, and said vane elements disposed in planes that diverge transversely laterally outwardly and extending from the support member and laterally outwardly from said first side through at least the inner and said outer region, respectively, toward an opposite side of each blade, wherein said support members connect integrally at an apex adjacent said inner region.

2. An air diffuser according to claim 1 wherein each vane element extends at an angle of inclination transversely outwardly away from its support member in the direction from said first side edge toward said opposite side edge.

3. An air diffuser according to claim 3 wherein said angle of inclination is 0° to about 40° with respect to a plane parallel to said axis.

4. An air diffuser according to claim 4 wherein said angle is about 10° to about 25°.

5. An air diffuser according to claim 5 wherein said angle is about 15° to about 20°.

6. An air diffuser according to claim 3 wherein each vane element inclines transversely outwardly from a transversely outer edge of its support member.

7. An air diffuser according to claim 1 wherein each support member and the vane element connected thereto extend at an angle of divergence to a lateral plane of about 10° to about 60°.

8. An air diffuser according to claim 1 wherein said angle of divergence is about 20° to about 50°.

9. An air diffuser according to claim 1 wherein said angle of divergence is about 30° to about 40°.

10. An air diffuser according to claim 1 wherein one of said support members has a series of said vane elements which includes first and second vane elements located adjacent to one another with said first vane element being located inwardly toward said apex relative to said second vane element, and wherein said first vane element has a rear edge facing away from said apex and said second vane element has a forward edge facing toward said apex, said rear edge of said first vane element having an inward recess therein, said inward recess extending inwardly toward said apex, and said forward edge of said second vane element has a barb extending inwardly from said forward edge toward said apex of said support members, said barb having a sharp apex, wherein, in a disassembled condition, said sharp apex of said barb projects into said inward recess of said first vane element, and in an assembled condition said support member flexes resiliently and a resilient reaction urges said barb toward and into biting engagement with one of said blades.

11. An air diffuser according to claim 1 wherein at least one blade comprises a first blade element parallel to said axis and a second blade element extending from an edge of said first blade element and inclining laterally outwardly with respect to said axis, said first and second blade elements each having an inner face directed inwardly with respect to said axis and an opposing outer face directed outwardly with respect to said axis, and wherein one of said support members has a series of said vane elements which includes first and second vane elements located adjacent to one another with said first vane element being located inwardly toward said apex relative to said second vane element, and wherein said first vane element has a rear edge facing away from said apex and said second vane element has a forward edge facing toward said apex, a first portion of said forward edge of said second vane element engaging said outer face of said first blade element, and said rear edge of said first vane element having an undercut portion projecting outwardly with respect to said axis beyond said first portion of said forward edge of said second vane element and engaging said inner face of said second blade element.

12. An air diffuser according to claim 11 wherein said forward edge of said second vane element has a second portion opposing said undercut portion of said first vane element and spaced therefrom a distance greater than the thickness of said second blade element.

13. A deflector structure comprising a support member and a series of vane elements connected thereto and extending therefrom and comprising at least a first vane element and a second vane element, each of said first and second vane elements having a leading edge and a trailing edge, with the trailing edge of the first vane element opposing said leading edge of said second vane element and being in proximate, spaced relation thereto, said trailing edge of said first vane element having a recess therein and said leading edge of said second vane element having a barb with a sharp apex projecting therefrom and into said recess of said trailing edge of said first vane element.

14. A deflector structure comprising a support member and a series of vane elements connected thereto and extending therefrom and comprising at least a first vane element and a second vane element, each of said first and second vane elements having a leading edge and a trailing edge, with the trailing edge of the first vane element opposing said leading edge of said second vane element and being in proximate, spaced relation thereto, and wherein said trailing edge of said first vane element has an undercut portion projecting beyond a first portion of said leading edge of said second vane element and being in spaced relation to a second portion of said leading edge of said second vane element.

* * * * *